US011578723B2

(12) United States Patent
Hebrard et al.

(10) Patent No.: US 11,578,723 B2
(45) Date of Patent: Feb. 14, 2023

(54) SCREW COMPRESSOR FOR A UTILITY VEHICLE

(71) Applicant: KNORR-BREMSE Systeme fuer Nutzfahrzeuge GmbH, Munich (DE)

(72) Inventors: Gilles Hebrard, Munich (DE); Jean-Baptiste Marescot, Munich (DE); Joerg Mellar, Munich (DE); Thomas Weinhold, Munich (DE)

(73) Assignee: KNORR-BREMSE Systeme fuer Nutzfahrzeuge GmbH, Munich (DE)

( * ) Notice: Subject to any disclaimer, the term of this patent is extended or adjusted under 35 U.S.C. 154(b) by 49 days.

(21) Appl. No.: 16/333,376

(22) PCT Filed: Sep. 19, 2017

(86) PCT No.: PCT/EP2017/073542
§ 371 (c)(1),
(2) Date: Apr. 15, 2019

(87) PCT Pub. No.: WO2018/054859
PCT Pub. Date: Mar. 29, 2018

(65) Prior Publication Data

US 2019/0390672 A1 Dec. 26, 2019

(30) Foreign Application Priority Data

Sep. 21, 2016 (DE) ..... 10 2016 011 431.2

(51) Int. Cl.
*F04C 18/16* (2006.01)
*F04C 18/08* (2006.01)

(52) U.S. Cl.
CPC ..... *F04C 18/16* (2013.01); *F04C 18/084* (2013.01); *F04C 2240/20* (2013.01)

(58) Field of Classification Search
CPC .... F04C 18/16; F04C 18/084; F04C 2240/20; F04C 29/005; F04C 2270/13; F04C 2210/221; F04C 2210/1005; F04C 2240/40; F04C 2210/206; F04C 29/02; F04C 18/082; F04C 29/042; F04C 29/026;
(Continued)

(56) References Cited

U.S. PATENT DOCUMENTS 3,307,777 A 3/1967 Shibbye
3,785,755 A * 1/1974 Novak ..... F04C 29/042 418/85
(Continued)

FOREIGN PATENT DOCUMENTS

CN 86 1 08274 A 8/1987
CN 1425853 A 6/2003
(Continued)

OTHER PUBLICATIONS

English Abstractor CN201335014Y (Year: 2008).*
(Continued)

*Primary Examiner* — Dominick L Plakkoottam
*Assistant Examiner* — Paul W Thiede
(74) *Attorney, Agent, or Firm* — Crowell & Moring LLP

(57) ABSTRACT

A screw compressor for a utility vehicle has at least one female screw, at least one male screw that meshes with the female screw, and at least one screw compressor drive which drives the female screw.

5 Claims, 3 Drawing Sheets

(58) Field of Classification Search
CPC ..... F05B 2240/20; F05B 2210/12; F05B 2210/16; F24H 3/06; F01K 15/00
See application file for complete search history.

(56) References Cited

U.S. PATENT DOCUMENTS

| | | | | | |
|---|---|---|---|---|---|
| 4,004,864 | A * | 1/1977 | Schibbye | F04C 29/12 | 418/1 |
| 4,490,102 | A * | 12/1984 | Carre | F01C 21/10 | 418/178 |
| 5,223,052 | A | 6/1993 | Yamamoto et al. | | |
| 5,364,250 | A | 11/1994 | Aoki et al. | | |
| 6,073,517 | A * | 6/2000 | Pauwels | F04C 29/06 | 74/606 R |
| 2003/0108446 | A1* | 6/2003 | Hida | F04C 18/084 | 418/201.1 |
| 2008/0044307 | A1 | 2/2008 | Koeck | | |
| 2008/0206085 | A1 | 8/2008 | Zieglgansberger | | |
| 2009/0252632 | A1* | 10/2009 | Daniels | F04C 29/026 | 418/84 |
| 2010/0254845 | A1* | 10/2010 | Nemit, Jr. | F04C 18/16 | 418/201.2 |
| 2011/0014077 | A1* | 1/2011 | Martens | F04C 29/042 | 418/84 |
| 2014/0017110 | A1* | 1/2014 | Zemliak | F04C 18/082 | 418/89 |
| 2014/0102103 | A1* | 4/2014 | Yamamoto | F01K 15/00 | 60/658 |
| 2015/0361975 | A1* | 12/2015 | Kouzel | F04B 49/08 | 417/53 |
| 2016/0161147 | A1* | 6/2016 | Lorenson | F24H 3/06 | 123/41.49 |
| 2016/0186757 | A1* | 6/2016 | Collins | F04C 18/16 | 418/83 |
| 2019/0203718 | A1* | 7/2019 | Hebrard | F01C 21/10 | |
| 2019/0211825 | A1* | 7/2019 | Hebrard | F04C 18/16 | |

FOREIGN PATENT DOCUMENTS

| | | | | |
|---|---|---|---|---|
| CN | 103275778 | A | 9/2013 | |
| DE | 1 428 277 | C2 | 1/1970 | |
| DE | 41 11 110 | C2 | 10/1991 | |
| DE | 102016011436 | A * | 3/2018 | |
| EP | 0 879 965 | A1 | 11/1998 | |
| EP | 2 889 485 | B1 | 8/2016 | |
| GB | 994325 | A * | 6/1965 | F04C 29/02 |
| JP | 2-201072 | A | 8/1990 | |
| JP | 6-193573 | A | 7/1994 | |
| JP | 2003-184769 | A | 7/2003 | |
| JP | 2008-523315 | A | 7/2008 | |
| JP | 2009-501290 | A | 1/2009 | |
| JP | 2010-209746 | A | 9/2010 | |
| JP | 2014-66190 | A | 4/2014 | |

OTHER PUBLICATIONS

Chinese-language Office Action issued in counterpart Chinese Application No. 201780058128.5 dated Aug. 26, 2019 with partial English translation (seven (7) pages).
Japanese-language Office Action issued in Japanese Application No. 2019-536668 dated May 19, 2020 with English translation (10 pages).
International Search Report (PCT/ISA/210) issued in PCT Application No. PCT/EP2017/073542 dated Dec. 1, 2017 with English translation (six (6) pages).
Japanese-language Written Opinion (PCT/ISA/237) issued in PCT Application No. PCT/EP2017/073542 dated Dec. 1, 2017 (six (6) pages).
Japanese-language Office Action issued in counterpart Japanese Application No. 102016011431.2 dated Sep. 19, 2017 (four (4) pages).
International Preliminary Report on Patentability (PCT/IB/326 & PCT/IB/373) issued in PCT Application No. PCT/EP2017/073542 dated Apr. 4, 2019, including English translation of document C2 (German-language Written Opinion (PCT/ISA/237 previously filed on Mar. 14, 2019)) (eight (8) pages).
Japanese-language Office Action issued in Japanese Application No. 2019-536668 dated Sep. 7, 2020 with English translation (10 pages).
Korean-language Office Action issued in Korean Application No. 10-2019-7009849 dated Oct. 15, 2020 with English translation (10 pages).
Portuguese-language Brazilian Office Action issued in Brazilian application No. BR112019005060-4 dated Nov. 4, 2021 (Four (4) pages).
German-language European Office Action issued in European application No. 17 776 968.4-1004 dated Nov. 22, 2021 (Four (4) pages).
Chinese Office Action issued in Chinese application No. 201780058128.5 dated Nov. 18, 202, with partial English translation (Eleven (11) pages).
Daxian Cheng, "Structure and Combination of System and Complete Machine", *Mechanical Design Atlas*, vol. 4, Chemical Industry Press, Mar. 31, 2000, pp. 802-803, Chinese-language (Three (3) pages).

* cited by examiner

SCREW COMPRESSOR FOR A UTILITY VEHICLE

BACKGROUND AND SUMMARY OF THE INVENTION

The present invention relates to a screw compressor for a utility vehicle, having at least one female screw, at least one male screw which meshes with the female screw, and having at least one screw compressor drive.

Screw compressors for utility vehicles are already known from the prior art. Such screw compressors are used to provide the compressed air required for the brake system of the utility vehicle, for example.

In this context, in particular oil-filled compressors, in particular also screw compressors, are known, in the case of which it is necessary to regulate the oil temperature. This is generally realized by virtue of an external oil cooler being provided which is connected to the oil-filled compressor and to the oil circuit via a thermostat valve. Here, the oil cooler is a heat exchanger which has two mutually separate circuits, wherein the first circuit is provided for the hot liquid, that is to say the compressor oil, and the second circuit is provided for the cooling liquid. As cooling liquid, use may for example be made of air, water mixtures with an antifreeze, or another oil.

This oil cooler must then be connected to the compressor oil circuit by means of pipes or hoses, and the oil circuit must be safeguarded against leakage.

This external volume must furthermore be filled with oil, such that the total quantity of oil is also increased. The system inertia is thus increased. Furthermore, the oil cooler must be mechanically accommodated and fastened, either by means of brackets situated in the surroundings or by means of a separate bracket, which necessitates additional fastening means and also structural space.

DE 41 11 110 C2 has already disclosed a rotary displacement machine of screw-type construction and a method for the surface coating of the rotors thereof. Here, the rotary displacement machine, which may be in the form of a screw compressor, has an arrangement in which both rotors can be driven.

It is the object of the present invention to advantageously further develop a screw compressor for a utility vehicle of the type mentioned in the introduction, in particular such that a screw compressor for a utility vehicle can be operated in a relatively efficient manner and with little generation of noise.

This object is achieved according to the invention by a screw compressor for a utility vehicle, having at least one female screw, at least one male screw which meshes with the female screw, and at least one screw compressor drive, wherein the screw compressor drive drives the female screw.

The invention is based on the underlying concept that, normally, the female screw in a screw compressor rotates more slowly than the male screw. The compressed-air generating power is however dependent on the rotational speed of the screws, which in turn influences the rotational speed of the drive. At certain rotational speeds of the screw compressor drive, in particular in the event of particular rotational speeds being overshot, the characteristics are such that the generation of noise by the screw compressor drive increases considerably. By virtue of the more slowly-rotating screw being driven, it can be achieved that, with the same rotational speed of the screw compressor drive, a higher rotational speed of the non-driven male screw is attained, whereby, overall, a higher compressor power of the screw compressor can be attained with the same level of noise generation.

In particular, provision may be made for the number of teeth of the female screw to be higher than that of the male screw. In this way, it is made possible for the ratio of the rotational speeds of the female screw and of the male screw to be set correspondingly in relation to one another.

Furthermore, provision may be made for the transmission ratio of female screw to male screw to be two to three. It is thus made possible for the speed ratios to likewise be set in the ratio two to three.

Here, the female screw may have 6 teeth and the male screw may have 4 teeth. In this way, it is made possible to realize a relatively simple design and a highly effective transmission ratio. Simple production is possible, and relatively quiet operation with high compressor power can be achieved.

The female screw and the male screw may have substantially the same nominal diameter. In this way, the meshing of the male screw and of the female screw with one another is simplified. Furthermore, the mounting of the screws in the housing of the screw compressor is also improved in this way.

In particular, provision may be made for the male screw to be driven exclusively by the female screw. A simple embodiment of the screw compressor is achieved in this way. Also, the efficiency of the screw compressor is improved overall in this way.

The transmission of torque from the screw compressor drive to the female screw may take place substantially coaxially. In this way, it is made possible for the introduction of radial forces and radially acting moments into the female screw to be reduced. An improvement of the service life is made possible in this way. Furthermore, it is thus possible to better realize higher rotational speeds.

Further details and advantages of the invention will now be discussed in more detail on the basis of an exemplary embodiment illustrated in the drawings.

DETAILED DESCRIPTION OF THE DRAWINGS

Figure 1:
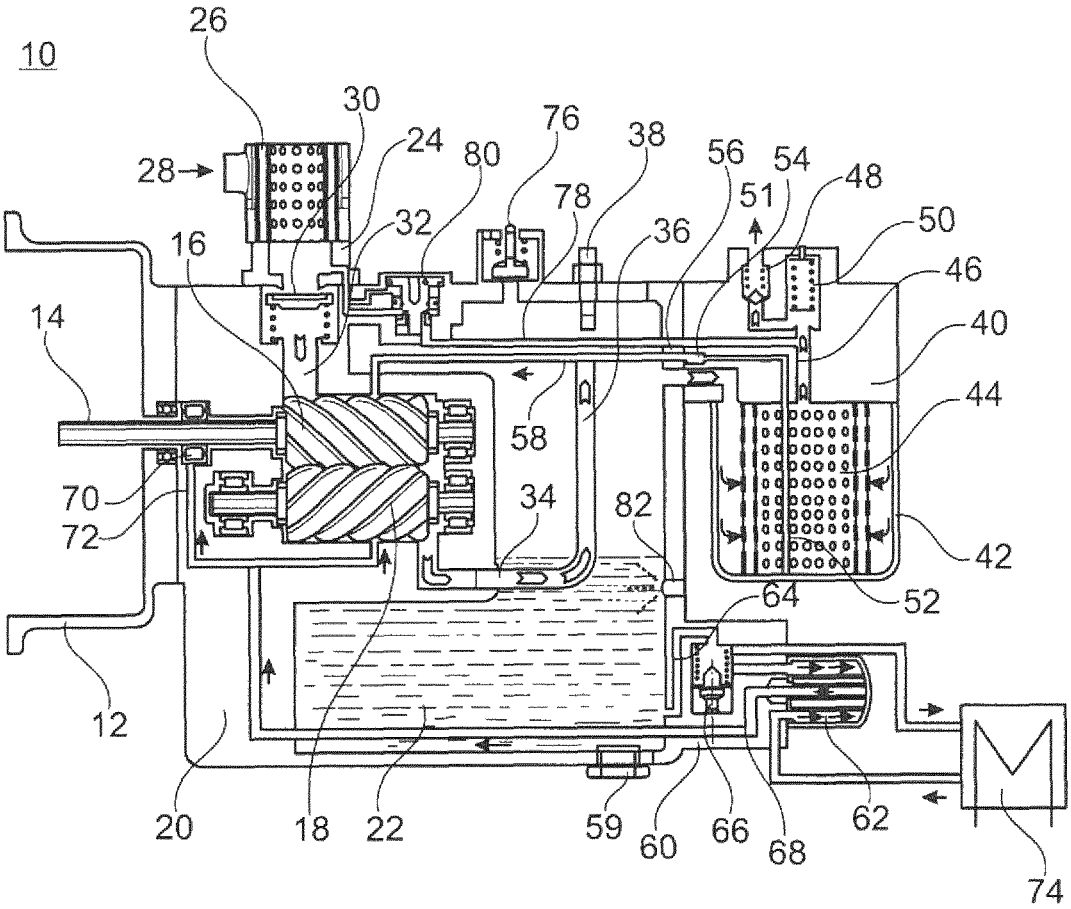
FIG. 1 shows a schematic sectional drawing through a screw compressor according to the invention.

FIG. 1 shows, in a schematic sectional illustration, a screw compressor 10 in the context of an exemplary embodiment of the present invention.

The screw compressor 10 has a fastening flange 12 for the mechanical fastening of the screw compressor 10 to an electric motor (not shown in any more detail here).

What is shown, however, is the input shaft 14, by which the torque from the electric motor is transmitted to one of the two screws 16 and 18, specifically the screw 16.

The screw 18 meshes with the screw 16 and is driven by means of the latter.

The screw compressor 10 has a housing 20 in which the main components of the screw compressor 10 are accommodated.

The housing 20 is filled with oil 22.

At the air inlet side, an inlet connector 24 is provided on the housing 20 of the screw compressor 10. The inlet connector 24 is in this case designed such that an air filter 26 is arranged at said inlet connector. Furthermore, an air inlet 28 is provided radially on the air inlet connector 24.

In the region between the inlet connector 24 and the point at which the inlet connector 24 joins to the housing 20, there is provided a spring-loaded valve insert 30, which is designed here as an axial seal.

The valve insert 30 serves as a check valve.

Downstream of the valve insert 30, there is provided an air feed channel 32 which feeds the air to the two screws 16, 18.

At the outlet side of the two screws 16, 18, there is provided an air outlet pipe 34 with a riser line 36.

In the region of the end of the riser line 36, there is provided a temperature sensor 38 by means of which the oil temperature can be monitored.

Also provided in the air outlet region is a holder 40 for an air deoiling element 42.

In the assembled state, the holder 40 for the air deoiling element has the air deoiling element 42 in the region facing toward the base (as also shown in FIG. 1).

Also provided, in the interior of the air deoiling element 42, is a corresponding filter screen or known filter and oil separation devices 44, which will not be specified in any more detail.

In the central upper region in relation to the assembled and operationally ready state (that is to say as shown in FIG. 1), the holder for the air deoiling element 42 has an air outlet opening 46 which leads to a check valve 48 and a minimum pressure valve 50. The check valve 48 and the minimum pressure valve 50 may also be formed in one common combined valve.

The air outlet 51 is provided downstream of the check valve 48.

The air outlet 51 is generally connected to correspondingly known compressed-air consumers.

In order for the oil 22 that is situated and separated off in the air deoiling element 42 to be returned again into the housing 20, a riser line 52 is provided which has a filter and check valve 54 at the outlet of the holder 40 for the air deoiling element 42 at the transition into the housing 20.

A nozzle 56 is provided, downstream of the filter and check valve 54, in a housing bore. The oil return line 58 leads back into approximately the central region of the screw 16 or of the screw 18 in order to feed oil 22 thereto again.

An oil drain screw 59 is provided in the base region, in the assembled state, of the housing 20. By means of the oil drain screw 59, a corresponding oil outflow opening can be opened, via which the oil 22 can be drained.

Also provided in the lower region of the housing 20 is the attachment piece 60 to which the oil filter 62 is fastened. Via an oil filter inlet channel 64, which is arranged in the housing 20, the oil 22 is conducted firstly to a thermostat valve 66.

Instead of the thermostat valve 66, it is possible for an open-loop and/or closed-loop control device to be provided by which the oil temperature of the oil 22 situated in the housing 20 can be monitored and set to a setpoint value.

Downstream of the thermostat valve 66, there is then the oil inlet of the oil filter 62, which, via a central return line 68, conducts the oil 22 back to the screw 18 or to the screw 16 again, and also to the oil-lubricated bearing 70 of the shaft 14. Also provided in the region of the bearing 70 is a nozzle 72, which is provided in the housing 20 in conjunction with the return line 68.

The cooler 74 is connected to the attachment piece 60.

In the upper region of the housing 20 (in relation to the assembled state), there is situated a safety valve 76, by which an excessively high pressure in the housing 20 can be dissipated.

Upstream of the minimum pressure valve 50, there is situated a bypass line 78, which leads to a relief valve 80. Via said relief valve 80, which is activated by a connection to the air feed channel 32, air can be returned into the region of the air inlet 28. In this region, there may be provided a ventilation valve (not shown in any more detail) and also a nozzle (diameter constriction of the feeding line).

Furthermore, approximately at the level of the air outlet pipe 34, an oil level sensor 82 may be provided in the outer wall of the housing 20. Said oil level sensor 82 may for example be an optical sensor, and may be designed and configured such that, on the basis of the sensor signal, it can be identified whether the oil level during operation is above the oil level sensor 82 or whether the oil level sensor 82 is exposed, and thus the oil level has correspondingly fallen.

In conjunction with this monitoring, it is also possible for an alarm unit to be provided which outputs or transmits a corresponding error message or warning message to the user of the system.

The function of the screw compressor 10 shown in FIG. 1 is as follows.

Air is fed via the air inlet 28 and passes via the check valve 30 to the screws 16, 18, where the air is compressed. The compressed air-oil mixture, which, having been compressed by a factor of between 5 and 16 downstream of the screws 16 and 18, rises through the outlet line 34 via the riser pipe 36, is blown directly onto the temperature sensor 38.

The air, which still partially carries oil particles, is then conducted via the holder 40 into the air deoiling element 42 and, if the corresponding minimum pressure is attained, passes into the air outlet line 51.

The oil 22 situated in the housing 20 is kept at operating temperature via the oil filter 62 and possibly via the heat exchanger 74.

If no cooling is necessary, the heat exchanger 74 is not used and is also not activated.

The corresponding activation is performed by the thermostat valve 66. After purification in the oil filter 62, oil is fed via the line 68 to the screw 18 or to the screw 16, and also to the bearing 70. The screw 16 or the screw 18 is supplied with oil 22 via the return line 52, 58, and the purification of the oil 22 takes place here in the air deoiling element 42.

By means of the electric motor (not shown in any more detail), which transmits its torque via the shaft 14 to the screw 16, which in turn meshes with the screw 18, the screws 16 and 18 of the screw compressor 10 are driven.

By means of the relief valve 80 (not shown in any more detail), it is ensured that the high pressure that prevails for example at the outlet side of the screws 16, 18 in the operational state cannot be enclosed in the region of the feed line 32, and that, instead, in particular during the start-up of the compressor, there is always a low inlet pressure, in particular atmospheric pressure, prevailing in the region of the feed line 32. Otherwise, upon a start-up of the compressor, a very high pressure would initially be generated at the outlet side of the screws 16 and 18, which would overload the drive motor.

Figure 2:
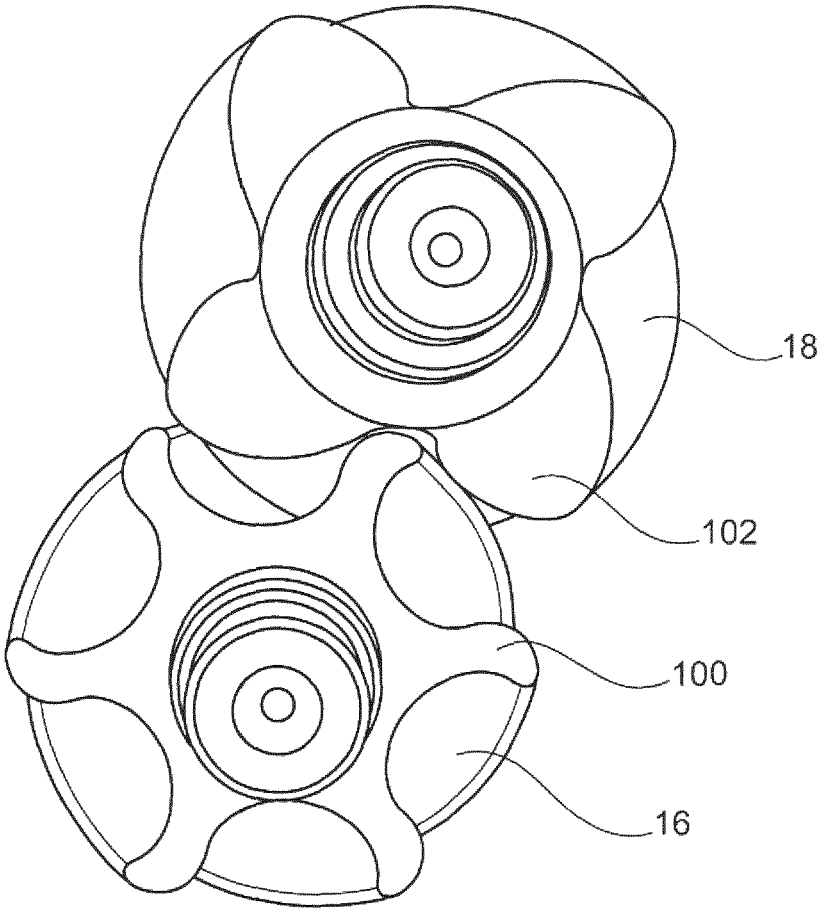
FIG. 2 shows a schematic frontal view of the intermeshing male and female screws of the screw compressor.

FIG. 2 shows, in a frontal illustration, the intermeshing female screw 16 and the male screw 18.

As can be clearly seen from FIG. 2, the female screw 16 has six screw teeth 100 which are of identical construction and which are distributed uniformly over the circumference.

By contrast, the male screw 18 has four screw teeth 102, which are likewise distributed uniformly over the circumference.

The number of teeth 100 of the female screw 16 is thus greater than that of the male screw 18.

By means of such a design, a transmission ratio of female screw 16 to male screw 18 of two to three is formed.

The female screw 16 and the male screw 18 have substantially the same nominal diameter.

Figure 3:
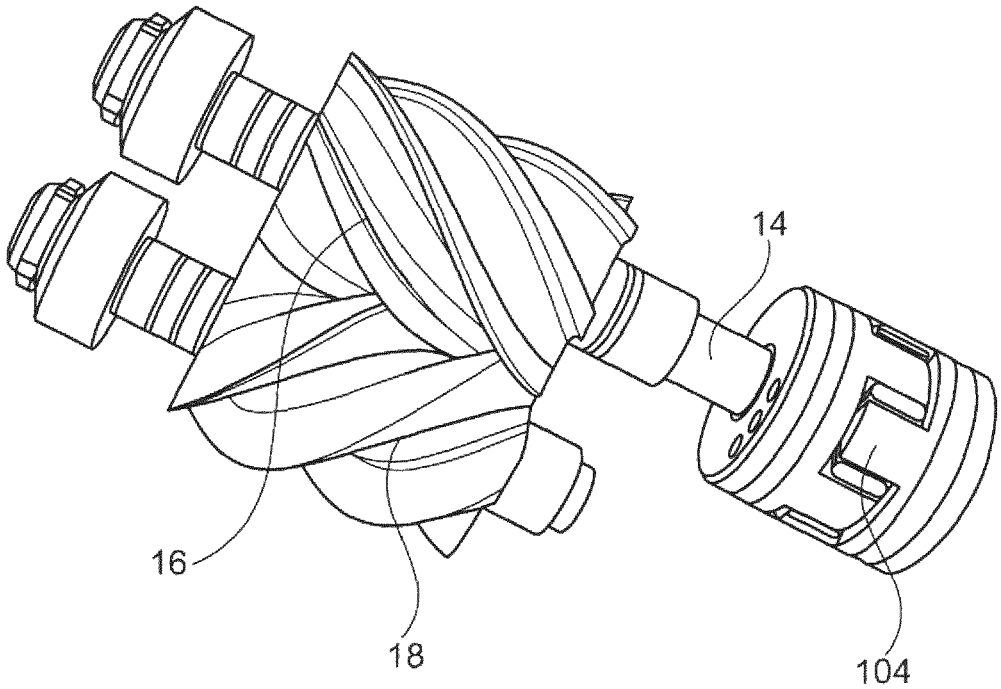
FIG. 3 shows a perspective view of the male and female screws as per FIG. 2.

As can also be seen from FIG. 3, which shows a perspective view of the screws 16, 18, the male screw 18 is driven exclusively by the female screw 16.

The female screw 16 is equipped with an axial coupling 104, via which the input shaft 14 of the female screw 16 is driven axially by the screw compressor drive, in this case an electric motor (not illustrated in any more detail).

The screw compressor drive thus drives exclusively the female screw 16.

The transmission of torque from the screw compressor drive to the female screw 16 takes place substantially coaxially.

By means of this embodiment, it is achieved that the rotational speed of the female screw 16 is for example approximately 1000 revolutions per minute, whereas the rotational speed of the male screw 18 is approximately 1500 revolutions per minute (rotational speed ratios at higher or lower rotational speeds assume corresponding values).

It is thus achieved that the rotational speed of the screw compressor drive and of the female screw 16 is identical, whereas the rotational speed of the male screw 18 is considerably higher. In order to maximize the compressed-air generating power, the so-called tip speed, that is to say the speed of the tooth tips, must be selected to be as high as possible, which can be achieved by means of the selected embodiment.

By means of the coaxial transmission of torque from the screw compressor drive to the female screw 16, this is assisted yet further, and furthermore, the mounting of the female and male screws 16, 18 is also greatly simplified.

LIST OF REFERENCE DESIGNATIONS

10 Screw compressor
12 Fastening flange
14 Input shaft
16 Screws
18 Screws
20 Housing
22 Oil
24 Inlet connector
26 Air filter
28 Air inlet
30 Valve insert
32 Air feed channel
34 Air outlet pipe
36 Riser line
38 Temperature sensor
40 Holder for an air deoiling element
42 Air deoiling element
44 Filter screen or known filter or oil separation devices
46 Air outlet opening
48 Check valve
50 Minimum pressure valve
51 Air outlet
52 Riser line
54 Filter and check valve
56 Nozzle
58 Oil return line
59 Oil drain screw
60 Attachment piece
**60*a*** Outer ring
**60*b*** Inner ring
62 Oil filter
64 Oil filter inlet channel
66 Thermostat valve
68 Return line
70 Bearing
72 Nozzle
74 Cooler, heat exchanger
76 Safety valve
78 Bypass line
80 Relief valve
82 Oil level sensor
100 Screw teeth
102 Screw teeth
104 Axial coupling

What is claimed is:

1. A screw compressor for a utility vehicle, comprising:
a housing;
at least one female screw;
at least one male screw which meshes with the female screw,
wherein the female screw and the male screw are mounted in the housing;
oil collected in a bottom portion of the housing, the collected oil directly underlying the at least one female screw and the at least one male screw;
a temperature sensor mounted on the housing and at least partially extending outwardly away from the housing, wherein a temperature of the collected oil in the housing is monitorable by the temperature sensor;
an oil filter in fluid communication with the collected oil, the oil filter being mounted on the housing and at least partially extending away from the housing external to the housing;
a heat exchanger in fluid communication with the oil filter and positioned external to the housing;
wherein the collected oil in the bottom portion of the housing is kept at an operating temperature by the oil filter and the heat exchanger; and
at least one screw compressor drive positioned external to the housing, wherein the screw compressor drive drives the female screw;
an air deoiling element connected to a holder attached to the housing and positioned external to the housing, the air deoiling element being in fluid communication with an air outlet line of the screw compressor defined in the holder;
wherein the female screw has an axial coupling and an input shaft and wherein the input shaft is axially driven by the screw compressor drive via the axial coupling, wherein the input shaft passes through an opening in the housing;
wherein transmission of torque from the screw compressor drive to the female screw takes place substantially coaxially;
wherein the male screw is driven exclusively by the female screw.

2. The screw compressor as claimed in claim 1, wherein a number of teeth of the female screw is greater than that of the male screw.

3. The screw compressor as claimed in claim 2, wherein a transmission ratio of the female screw to the male screw is two to three.

4. The screw compressor as claimed in claim 3, wherein the female screw has six teeth and the male screw has four teeth.

5. The screw compressor as claimed in claim 1, wherein the female screw and the male screw have substantially the same nominal diameter.

* * * * *